US005380636A

United States Patent [19]

Malfatto et al.

[11] Patent Number: 5,380,636

[45] Date of Patent: Jan. 10, 1995

[54] MULTICONTRAST RADIOGRAPHIC FILM-SCREEN ASSEMBLY

[75] Inventors: Pierfiore Malfatto, Cairo Montenotte; Sergio Pesce, Savona; Elio Cavallo, Carcare, all of Italy

[73] Assignee: Minnesota Mining & Manufacturing Company, St. Paul, Minn.

[21] Appl. No.: 114,848

[22] Filed: Sep. 2, 1993

[30] Foreign Application Priority Data

Oct. 5, 1992 [IT] Italy ..... MI92 A 002294

[51] Int. Cl.[6] ..... G03C 1/46

[52] U.S. Cl. ..... 430/503; 430/502; 430/509; 430/508; 430/139; 430/966; 430/434; 428/690; 252/301.4 R; 378/185

[58] Field of Search ..... 430/502, 509, 508, 139, 430/966, 434, 503; 428/690; 252/301.4 R; 378/185

[56] References Cited

U.S. PATENT DOCUMENTS

| | | | |
|---|---|---|---|
| 3,923,515 | 12/1975 | van Stappen | 430/346 |
| 4,024,069 | 5/1977 | Larach | 252/301.4 R |
| 4,585,729 | 4/1986 | Sugimoto et al. | 430/502 |
| 4,912,333 | 3/1990 | Roberts et al. | 250/487.11 |
| 4,994,355 | 2/1991 | Dickerson et al. | 430/509 |
| 4,997,750 | 3/1991 | Dickerson et al. | 430/509 |
| 5,021,327 | 6/1991 | Bunch et al. | 430/502 |
| 5,108,881 | 4/1992 | Dickerson et al. | 430/502 |
| 5,252,443 | 10/1993 | Dickerson | 430/502 |

FOREIGN PATENT DOCUMENTS

| | | | |
|---|---|---|---|
| 0084637 | 8/1983 | European Pat. Off. . | |
| 0350883 | 1/1990 | European Pat. Off. . | |
| 0384753 | 8/1990 | European Pat. Off. . | |
| 0412730A2 | 8/1990 | European Pat. Off. . | |
| 0437117 | 7/1991 | European Pat. Off. | 430/502 |

OTHER PUBLICATIONS

Research Disclosure, Item 18431, "Radiographic Films/Materials", Aug. 1979, J. W. Carpenter.

H1105, U.S. Statutory Invention Registration, Jebo et al., Sep. 1992.

*Primary Examiner*—Thomas R. Neville

*Attorney, Agent, or Firm*—Gary L. Griswold; Walter N. Kirn; Mark A. Litman

[57] ABSTRACT

The present invention relates to a symmetrical radiographic assembly comprising:

a double side radiographic element which comprises a support and hydrophilic colloid layers coated on each side of said support, and an intensifying screen adjacent to each side of said radiographic element, wherein on each side of said support are coated at least two silver halide emulsion layers having a speed difference of at least 0.5 logE and an average contrast difference of at least 0.5, said at least two silver halide emulsion layers being each sensitized to a different region of the electromagnetic spectrum, wherein said intensifying screen comprises one or more different light emitting phosphors selected in order to have a radiation light emission having an emission maximum wavelength corresponding to at least one of said different regions of the electromagnetic spectrum to which said at least two silver halide emulsion layers are sensitized, and wherein said radiographic element shows an average contrast proportionally variable with the emission ratio of said light emitting phosphor(s).

21 Claims, 5 Drawing Sheets

MULTICONTRAST RADIOGRAPHIC FILM-SCREEN ASSEMBLY

FIELD OF THE INVENTION

This invention relates to a radiographic assembly. More specifically, the invention relates to a radiographic assembly comprising a duplitized silver halide radiographic element and a pair of intensifying screens.

BACKGROUND OF THE ART

It is known in the art of medical radiography to employ intensifying screens to reduce the X-ray dosage to the patient. Intensifying screens absorb the X-ray radiation and emit electromagnetic radiations which can be better absorbed by silver halide emulsion layers. Another approach to reduce the X-ray dosage to the patient is to coat two silver halide emulsion layers on the opposite sides of a support to form a duplitized radiographic element.

Accordingly, it is a common practice in medical radiography to use a radiographic assembly consisting of a duplitized radiographic element interposed between a pair of front and back screens.

One of the problems of medical radiography relates to the different X-ray absorption of the various pads of the body. For example, in chest radiography the heart area has an absorption ten times higher than the lung area. A similar effect occurs in the radiography of the stomach, where a contrast medium is used in order to enhance the image depictivity (the body part having no contrast medium being totally black), and of hands and legs, where bones have an X-ray absorption higher than that of soft tissues such as flesh and cartilage.

In these cases a radiographic element showing a low contrast is required for area of high X-ray absorption and a radiographic element showing a high contrast is required for area of low X-ray absorption. The resulting film is a compromise in an attempt to have sufficient optical density and sharpness for these different areas of the body. In the art of chest radiography, X ray images providing visually discernible features in both the heart and lung image areas are attempted by using extended latitude radiographic elements. Extended latitude radiographic elements typically employ polydispersed silver halide emulsions to provide lower average contrasts and a wider range of exposures separating minimum and maximum density exposures. Said extended latitude radiographic elements, however, do not provide the desired sensitometric curve necessary to obtain visually useful imaging details in both head and lung areas. Various methods have been suggested to solve this problem. One approach relates to the use of double coated radiographic elements having a different emulsion layer coated on each side of the support. An example of this solution can be found in French patent 1,103,973, wherein the use of screens having a light emission ratio of from 1:1 to 1.5:1 (back screen:front screen) in combination with a radiographic element having coated thereon a high contrast back emulsion and a low contrast front emulsion is suggested. A combination of screens having a light emission ratio higher than 1.5:1 and radiographic elements having emulsion layers with the same gradation is also suggested. Other patents disclose the use of double coated radiographic elements having emulsion layers with different contrast or sensitivity. For example, DE 1,017,464 discloses a double coated radiographic element having coated thereon a first emulsion with high sensitivity and low contrast and a second emulsion with low sensitivity and high contrast, FR 885,707 discloses a double coated radiographic element having coated thereon a first high speed emulsion and a second high contrast emulsion, and FR 875,269 discloses a radiographic assembly comprising several radiographic films or papers, each having a different sensitivity and/or contrast relative to the others, in order to obtain separate and different images of the same object with a single exposure. Nothing in the above described patents suggests the use of the specific combination of the present invention to obtain a symmetric double-coated radiographic element showing a variable contrast according to the specific pair of intensifying screens. An approach similar to that of the above described French and German patents is disclosed in U.S. Pat. No. 4,994,355, claiming a double coated radiographic element having emulsion layers with different contrast, in U.S. Pat. No. 4,997,750, claiming a double coated radiographic element having emulsion layers with different sensitivity and in U.S. Pat. No. 5,021,327 claiming a radiographic assembly wherein the back screen and emulsion layer have a photicity at least twice that of the front screen and emulsion layer, the photicity being defined as the integrated product of screen emission and emulsion sensitivity. All these proposed solution require the use of an asymmetrical radiographic film which requires a specific orientation relative to the screens for a proper use.

The following are additional documents illustrating the state of the art.

FR 787,017 discloses a radiographic element comprising silver halide emulsion layers of different color sensitivity to be combined with intensifying screens emitting radiation to which the silver halides are sensitive. The purpose of this patent is to obtain a total use of radiation.

EP 88,820 discloses a radiographic fluorescent screen comprising a first blue emitting phosphor layer and a second green emitting phosphor layer to be combined with a silver halide element having spectral sensitivity in the blue-green region ("ortho-type" elements).

JP 60-175000 discloses a combination of a double coated silver halide element and a screen pair wherein the fluorescent layers of the two screens have different wavelength region emissions and each screen comprises an organic dye to absorb the light emitted by the opposite screen.

EP 350,883 discloses a technique for crossover reduction in which silver halide emulsion layers having different color sensitivities are provided on the opposite sides of a transparent support, and X-ray fluorescent intensifying screens having emission spectra corresponding to the respective color sensitivities are used.

Research Disclosure, December 1973, Vol. 116, Item 11620 discloses a radiographic element which shows different contrast when observed with or without a green filter, respectively.

Finally, EP 126,664 describes a radiographic material having a characteristic curve whose gamma between optical densities of 0.50 and 1.50 is 2.7 to 3.3 and gamma between optical densities of 2.00 and 3.00 is 1.5 to 2.5, said material having a wide exposure latitude to make possible the production of images having high diagnosis ability.

SUMMARY OF THE INVENTION

The present invention relates to a symmetrical radiographic assembly comprising:

a double side radiographic element which comprises a support and hydrophilic colloid layers coated on each side of said support, and an intensifying screen adjacent to each side of said radiographic element, wherein on each side of said support are coated at least two silver halide emulsion layers having a speed difference of at least 0.5 logE and an average contrast difference of at least 0.5, said at least two silver halide emulsion layers being each sensitized to a different region of the electromagnetic spectrum, wherein said intensifying screen comprises one or more different light emitting phosphors selected to have a radiation light emission having an emission maximum wavelength corresponding to at least one of said different regions of the electromagnetic spectrum to which said at least two silver halide emulsion layers are sensitized, and wherein said radiographic element shows an average contrast proportionally variable with the emission ratio of said light emitting phosphor(s).

In another aspect, the present invention relates to a double side radiographic element which comprises a support and hydrophilic colloid layers coated on each side of said support, wherein on each side of said support are coated at least two silver halide emulsion layers having a speed difference of at least 0.5 logE and an average contrast difference of at least 0.5, said at least two silver halide emulsion layers being each sensitized to a different region of the electromagnetic spectrum.

In a further aspect, the present invention relates to a process for obtaining a radiographic image comprising the step of (a) image-wise exposing to an X-ray radiation which has passed through an object, a symmetrical radio-graphic assembly comprising (i) a double side radiographic element having a support and at least two silver halide emulsion layers having a speed difference of at least 0.5 logE and an average contrast difference of at least 0.5 coated on each side thereof, said at least two silver halide emulsion layers being each sensitized to a different region of the electromagnetic spectrum, and (ii) an intensifying screen comprising one or more different light emitting phosphors selected to have a radiation light emission having an emission maximum wavelength corresponding to at least one of said different regions of the electromagnetic spectrum to which said at least two silver halide emulsion layers are sensitized, and (b) developing said exposed radiographic element.

By using the specific construction of the present invention it is possible to obtain a radiographic image with a different contrast simply by changing the phosphor(s) mixture ratio of the intensifying screens.

In other word it is possible to obtain a radiographic image having a high, medium, or low contrast simply by changing the wavelength and/or the percentage of the relative emission of the intensifying screens.

On the other hand, the symmetrical construction of the radiographic assembly of the present invention does not require a specific orientation of the radiographic element relative to the screens, so avoiding manual errors during manipulation.

DETAILED DESCRIPTION OF THE INVENTION

Figure 1A:
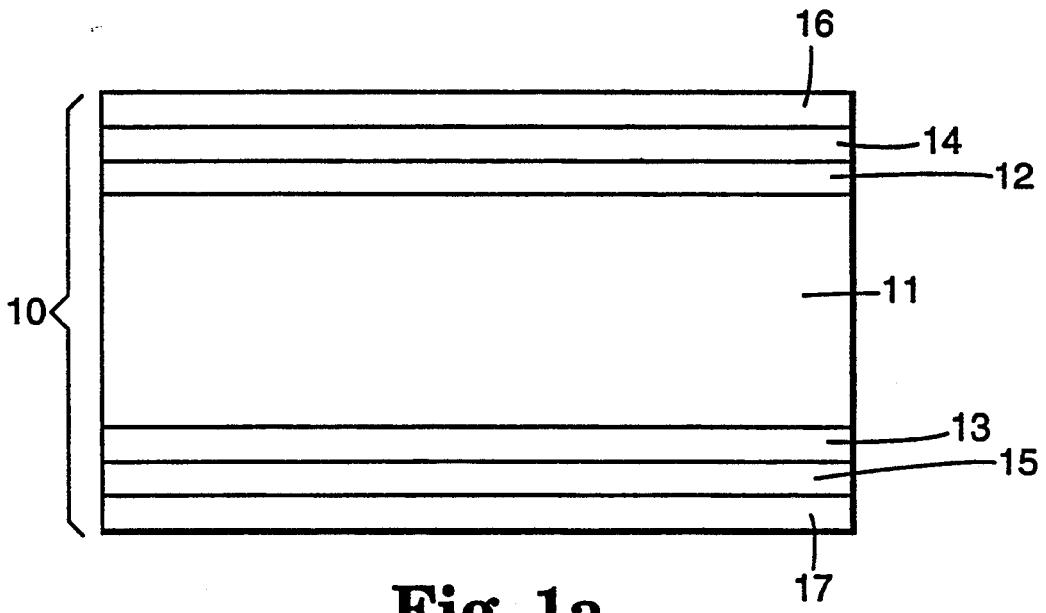
FIG. 1 is a schematic diagram of a radiographic element of the present invention.

Accordingly, the present invention relates to a symmetrical radiographic assembly comprising:

a double side radiographic element which comprises a support and hydrophilic colloid layers coated on each side of said support, and an intensifying screen adjacent to each side of said radiographic element, comprising a support and a fluorescent layer, wherein on each side of said support are coated at least two silver halide emulsion layers having a speed difference of at least 0.5 logE and an average contrast difference of at least 0.5, said at least two silver halide emulsion layers being each sensitized to a different region of the electromagnetic spectrum, wherein said intensifying screen comprises one or more different light emitting phosphors selected in order to have a radiation light emission having an emission maximum wavelength corresponding to at least one of said different regions of the electromagnetic spectrum to which said at least two silver halide emulsion layers are sensitized, and wherein said radiographic element shows an average contrast proportionally variable with the emission ratio of said light emitting phosphor(s).

As employed herein the term "symmetrical radiographic assembly" refers to a radiographic assembly which comprises a silver halide double coated radiographic element comprising identical silver halide emulsion layers coated on each side of the support, said radiographic element being interposed between a pair of identical intensifying screens. The back silver halide emulsion layers and screen are then identical to the front silver halide emulsion layers and screen.

As employed herein the term "electromagnetic spectrum" refers to radiations having a wavelength of from 300 to 1200 nm, i.e., comprising the ultraviolet, visible and infrared radiations.

As employed herein the term "emission ratio" relates to the relative emission of the phosphor(s) for each portion of the electro-magnetic spectrum to which said at least two silver halide emulsion layers are sensitized.

According to a preferred embodiment, the double side radio-graphic element of the present invention comprises two silver halide emulsion layers coated on each side of the support and each sensitized to a different region of the electromagnetic spectrum. However, the invention should not be intended to be limited to this solution. Three or more silver halide emulsion layers could be coated on each side of the support. In this case the third or following emulsion layer could be sensitized to a third or following region of the electromagnetic spectrum or, alternatively, could be sensitized to a region of the electromagnetic spectrum equal to that of one of said two silver halide emulsion layers.

Said silver halide emulsion layers are sensitized to regions having a wavelength difference of at least 50 nm, preferably at least 100 nm. In a more preferred embodiment one of said silver halide emulsion layers is sensitized to the actinic portion of the electromagnetic spectrum, and the other is sensitized to the non-actinic portion of the spectrum.

The terms "actinic" and "non-actinic" radiation according to the present invention are used to indicate, respectively, radiations of wavelength shorter than 500 nm (Ultraviolet and blue radiation), preferably from 300 to less than 500 nm, more preferably from 350 to 450 nm, and radiations of wavelength from 500 nm upwards (green, red and Infrared radiation), preferably from 500 to 1200 nm, more preferably from 500 to 600 nm.

Figure 1B:
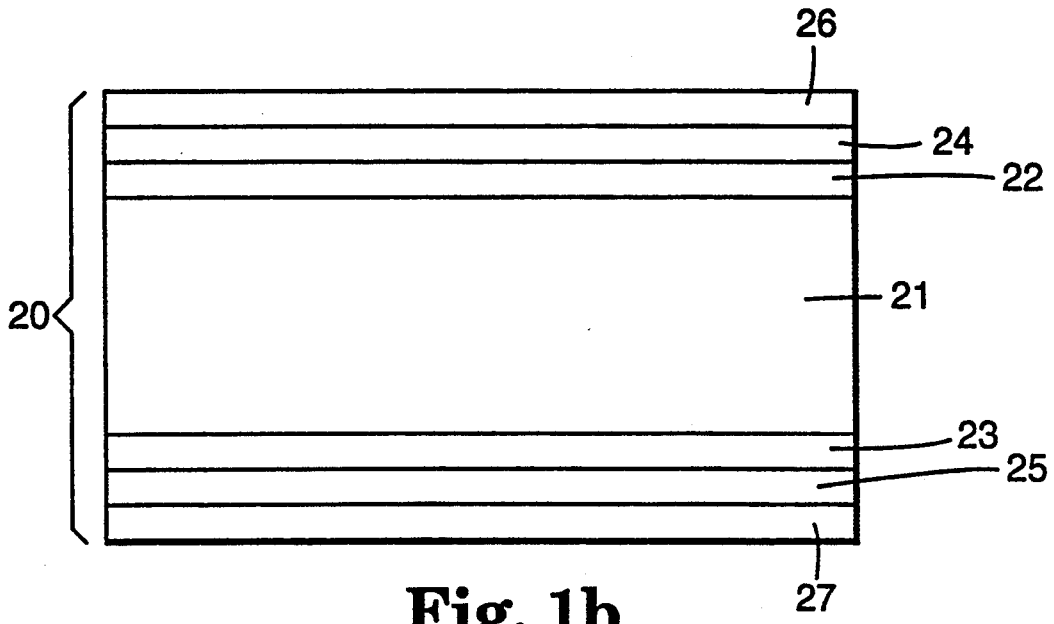
Figure 2A:
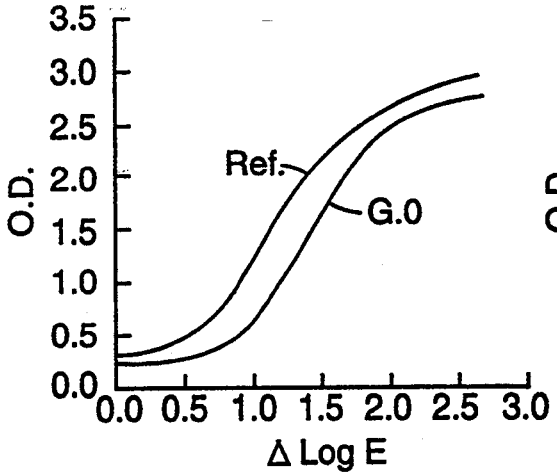
FIGS. 2 and 3 are graphs illustrating the sensitometric curves of the radiographic assemblies of the present invention in comparison with a reference.
Figure 2B:
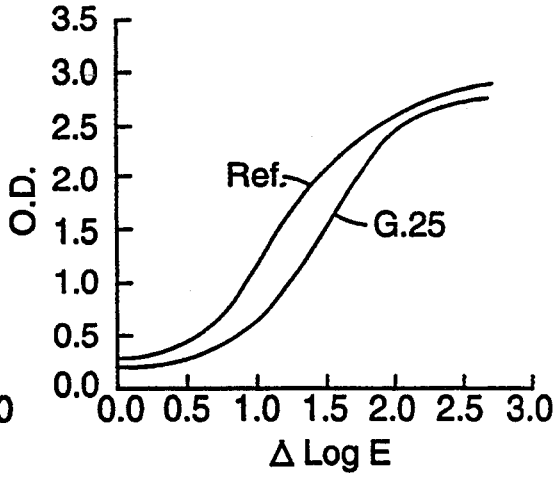
Figure 2C:
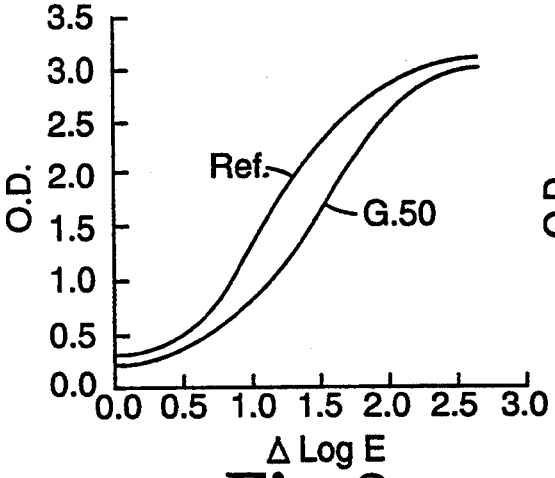
Figure 2D:
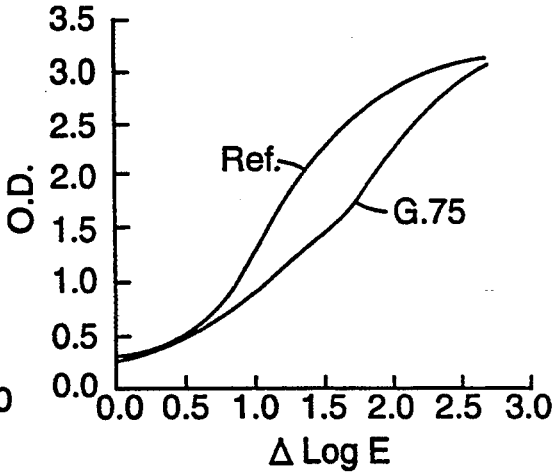
Figure 2E:
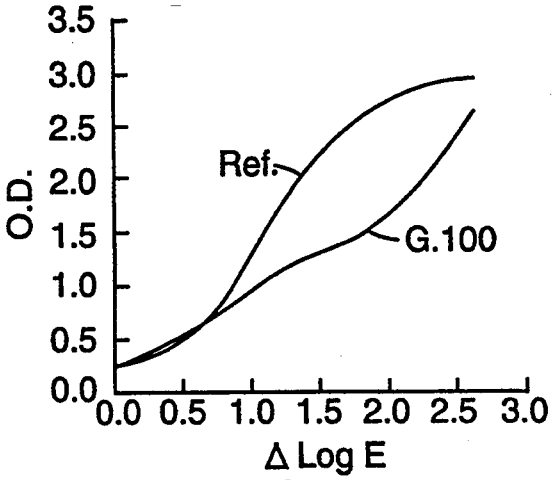
Figure 3A:
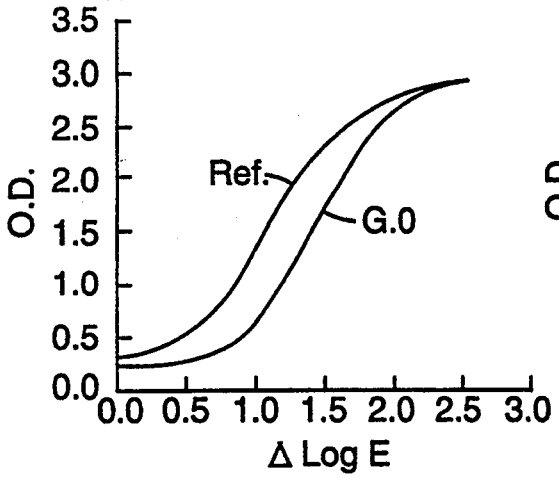
Figure 3B:
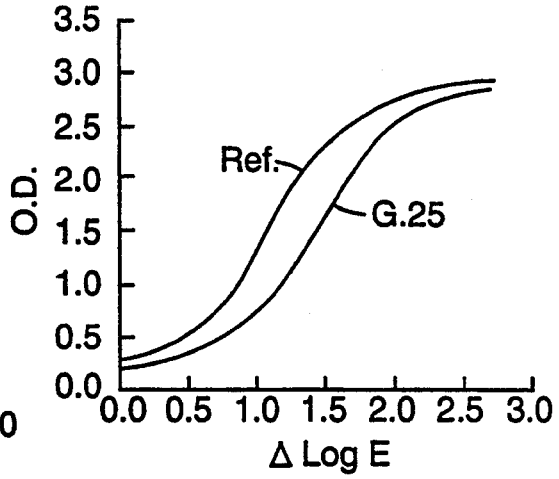
Figure 3C:
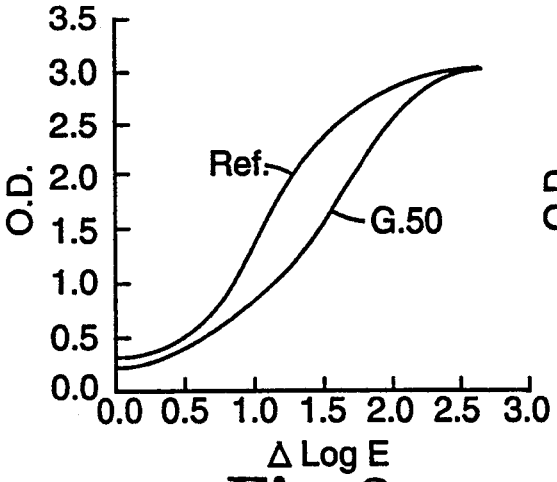
Figure 3D:
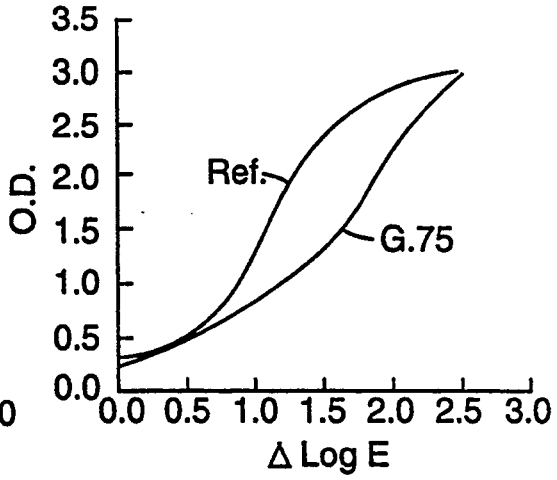
Figure 3E:
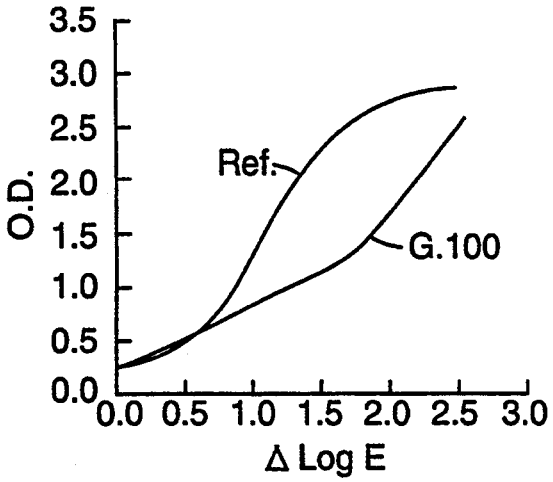

FIG. 1 shows two preferred embodiments of the radiographic element of the present invention. As showed in FIG. 1*a* the double coated silver halide radiographic element 10 comprises a support 11 and coated on its opposite faces are two green sensitized silver halide emulsion layers 12 and 13. A UV-blue sensitive silver halide emulsion layer 15 is coated over the green sensitized silver halide emulsion layer 13 and a UV-blue sensitive silver halide emulsion layer 14 is coated over the green sensitized silver halide emulsion layer 12 on the opposite face of the support. Protective layers 16 and 17 are coated over the silver halide emulsion layers 14 and 15, respectively. As showed in FIG. 1*b* the double coated silver halide radiographic element 20 comprises a support 21 and coated on its opposite faces are two UV-blue sensitive silver halide emulsion layers 22 and 23. A green sensitized silver halide emulsion layer 25 is coated over the UV-blue sensitive silver halide emulsion layer 23 and a green silver halide emulsion layer 24 is coated over the UV-blue sensitive silver halide emulsion layer 22 on the opposite face of the support. Protective layers 26 and 27 are coated over the silver halide emulsion layers 24 and 25, respectively.

According to the present invention, the double coated radiographic element comprises at least two silver halide emulsion layers having a difference of average contrast, based on density measurements at 0.25 and 2.00 above minimum density, of at least 0.5, and a difference in speed, measured at density 0.5 above minimum density, of at least 0.5 logE. The radiographic element of the present invention can comprise a third or following silver halide emulsion layer. In this case, these additional emulsion layers could have average contrast and/or speed further different or, alternatively, equal to one of said at least two silver halide emulsion layers.

The average contrast is the density difference divided by the log of the difference in exposure levels at the two density reference points on the characteristic curve, where the exposure levels are meter-candle-seconds. The contrast and the speed of each silver halide emulsion is determined by coating the silver halide emulsion under examination (the UV-blue sensitive emulsion or the green sensitive emulsion) on a support to provide an arrangement with the silver halide emulsion present on one side of the transparent support.

While the best choice of average contrast and speed differences between the first and the second emulsion layers can differ widely, depending upon the application to be served, in most instances the first and the second emulsion layers exhibit an average contrast difference in the range of from 0.5 to 2.0, optimally from 1.0 to 1.5, and a speed difference in the range of from 0.5 to 2.0 logE, optimally from 0.6 to 1.2 logE.

In the present invention, it is preferred that the lower average contrast silver halide emulsion layer exhibits a speed which is higher than that of the higher average contrast silver halide emulsion layer, since the lower average contrast emulsion unit is normally relied upon to provide image details in areas receiving the least exposure to X-radiation.

On the other hand, the preferred embodiment of the present invention provides the lower average contrast silver halide emulsion to be sensitized to the green portion of the electromagnetic spectrum and the higher average contrast silver halide emulsion to be sensitive to the UV-blue portion of the electromagnetic spectrum.

However, the present invention should not be intended to be limited to this specific embodiment. The skilled artisan can modify this specific selection in order to obtain the advantages of the present invention. Also, the choice of the green and UV-blue portion of the spectrum is not a limit of the present invention. While the speed and average contrast characteristic curve reference points have been arbitrarily selected, the selections are typical of those employed in the art.

Spectral sensitization can be performed with a variety of spectral sensitizing dyes known in the art. An example of such spectral sensitizing dyes is the polymethine dye class, including cyanines, complex cyanines, merocyanines, complex merocyanines, oxonols, hemioxonols, styryls, merostyryls and streptocyanines.

Although native UV-blue sensitivity of silver halides is usually known in the art, significant advantage can be obtained by the use of spectral sensitizing dyes, even when their principal absorption is in the spectral region to which the silver halide emulsion have their native sensitivity.

Preferably, spectral sensitizing dyes according to this invention are those which exhibit J aggregates if adsorbed on the surface of the silver halide grains and a sharp absorption band (J-band) with a bathocromic shifting with respect to the absorption maximum of the free dye in aqueous solution. Spectral sensitizing dyes producing J aggregates are well known in the art, as illustrated by F. M. Hamer, *Cyanine Dyes and Related Compounds*, John Wiley and Sons, 1964, Chapter XVII and by T. H. James, *The Theory of the Photographic Process*, 4th edition, Macmillan, 1977, Chapter 8.

In a preferred form, J-band exhibiting dyes are cyanine dyes. Such dyes comprise two basic heterocyclic nuclei joined by a linkage of methine groups. The heterocyclic nuclei preferably include fused benzene rings to enhance J aggregation.

The heterocyclic nuclei are preferably quinolinium, benzoxa-zolium, benzothiazolium, benzoselenazolium, benzimidazolium, naphth-oxazolium, naphthothiazolium and naphthoselenazolium quaternary salts.

J-band type dyes preferably used in the present invention have the following general formula (I):

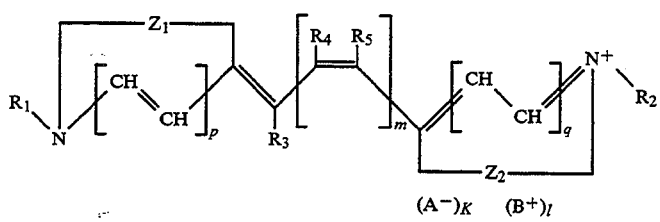

(I)

wherein $Z_1$ and $Z_2$ may be the same or different and each represents the elements necessary to complete a cyclic nucleus derived from basic heterocyclic nitrogen compounds such as oxazoline, oxazole, benzoxazole, the naphthoxazoles (e.g., naphth{2,1-d}oxazole, naphth-{2,3-d}-oxazole, and naphth-{1,2-d}oxazole), thiazoline, thiazole, benzothiazole, the naphthothiazoles (e.g., naphtho{2,1-d}thiazole), the thiazoloquinolines (e.g., thiazolo{4,5-b}quinoline), selenazoline, selenazole, benzoselenazole, the naphthoselenazoles (e.g., naphtho{1,2-d}selenazole, 3H-indole (e.g., 3,3-dimethyl3H-indole), the benzindoles (e.g., 1,1-dimethylbenzindole), imidazoline, imidazole, benzimidazole, the naphthimidazoles (e.g., naphth-{2,3-d}-imidazole), pyridine, and quinoline, which nuclei may be substituted on the ring by one or more of a wide variety of substitutes such as hydroxy, the halogens (e.g., fluoro, bromo, chloro, and iodo), alkyl groups or substituted alkyl groups (e.g., methyl, ethyl, propyl, isopropyl, butyl, octyl, dodecyl, 2-hydroxyethyl, 3-sulfopropyl, carboxymethyl, 2-cyanoethyl, and trifluoromethyl), aryl groups or substituted aryl groups (e.g., phenyl, 1-naphthyl, 2-naphthyl, 4-sulfophenyl, 3-carboxyphenyl, and 4-biphenyl), aralkyl groups (e.g., benzyl and phenethyl), alkoxy groups (e.g., methoxy, ethoxy, and isopropoxy), aryloxy groups (e.g., phenoxy and 1-naphthoxy), alkylthio groups (e.g., ethylthio and methylthio), arylthio groups (e.g., phenylthio, p-tolylthio, and 2-naphthylthio), methylenedioxy, cyano, 2-thienyl, styryl, amino or substituted amino groups (e.g., anilino, dimethylanilino, diethylanilino, and morpholino), acyl groups (e.g., acetyl and benzoyl), and sulfo groups, $R_1$ and $R_2$ can be the same or different and represent alkyl groups, aryl groups, alkenyl groups, or aralkyl groups, with or without substitutes, (e.g., carboxymethyl, 2-hydroxyethyl, 3-sulfopropyl, 3-sulfobutyl, 4-sulfobutyl, 2-methoxyethyl, 2-sulfatoethyl, 3-thiosulfatoethyl, 2-phos-phonoethyl, chloro-phenyl, and bromophenyl), $R_3$ represents a hydrogen atom, $R_4$ and $R_5$ can be the same or different and represent a hydrogen atom or a lower alkyl group of from 1 to 4 carbon atoms, p and q are 0 or 1, except that both p and q preferably are not 1, m is 0 or 1 except that when m is 1 both p and q are 0 and at least one of $Z_1$ and $Z_2$ represents imidazoline, oxazoline, thiazoline, or selenazoline, A is an anionic group, B is a cationic group, and k and l may be 0 or 1, depending on whether ionic substitutes are present. Variants are, of course, possible in which $R_1$ and $R_3$, $R_2$ and $R_5$, or $R_1$ and $R_2$ together represent the atoms necessary to complete an alkylene bridge.

Other references to well known spectral sensitizer can be found in Research Disclosure, Vol. 308, December 1989, Item 308119, Section IV. Research Disclosure is a publication of Kenneth Mason Publication Ltd., Emsworth, Hampshire PO10 7DD, United Kingdom.

In the most preferred form of this invention, the green sensitive silver halide emulsion is spectrally sensitized with a spectral sensitizing dyes adsorbed on said silver halide grains represented by the following general formula (11):

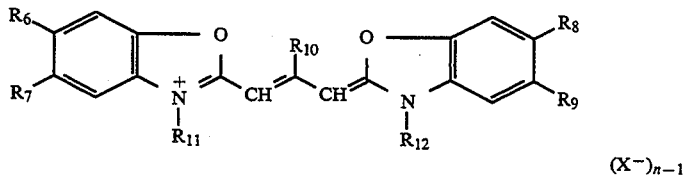

(II)

wherein $R_{10}$ represents a hydrogen atom or a lower alkyl group of from 1 to 4 carbon atoms (e.g. methyl, and ethyl), $R_6$, $R_7$, $R_8$ and $R_9$ each represents a hydrogen atom, a halogen atom (e.g. chloro, bromo, iodo, and fluoro), a hydroxy group, an alkoxy group (e.g. methoxy and ethoxy), an amino group (e.g. amino, methylamino, and dimethylamino), an acylamino group (e.g. acetamido and propionamido), an acyloxy group (e.g. acetoxy group), an alkoxycarbonyl group (e.g. methoxycarbonyl, ethoxycarbonyl, and butoxycarbonyl), an alkyl group (e.g. methyl, ethyl, and isopropyl), an alkoxycarbonylamino group (e.g. ethoxycarbonylamino) or an aryl group (e.g. phenyl and tolyl), or, together, $R_6$ and $R_7$ and, respectively, $R_8$ and $R_9$ can be the atoms necessary to complete a benzene ring (so that the heterocyclic nucleus results to be, for example, an $\alpha$-naphthoxazole nucleus, a ($\beta$-naphthoxazole or a $\beta,\beta'$- naphthoxazole), $R_{11}$ and $R_{12}$ each represents an alkyl group (e.g. methyl, propyl, and butyl), a hydroxyalkyl group (e.g. 2-hydroxyethyl, 3-hydroxypropyl, and 4-hydroxybutyl), an acetoxyalkyl group (e.g. 2-acetoxyethyl and 4-acetoxybutyl), an alkoxyalkyl group (e.g. 2-methoxyethyl and 3-methoxypropyl), a carboxyl group containing alkyl group (e.g. carboxymethyl, 2-carboxyethyl, 4-carboxybutyl, and 2-(2-carboxyethoxy)-ethyl), a sulfo group containing alkyl group (e.g. 2-sulfoethyl, 3-sulfopropyl, 4-sulfobutyl, 2-hydroxy-3-sulfopropyl, 2-(3-sulfoproxy)-propyl, p-sulfobenzyl, and p-sulfophenethyl), a benzyl group, a phenetyl group, a vinylmethyl group, and the like, $X^-$ represents an acid anion (e.g. a chloride, bromide, iodide, thiocyanate, methylsulfate, ethylsulfate, perchlorate, and p-toluensulfonate ion), and n represents 1 or 2.

The alkyl groups included in said substitutes $R_6$, $R_7$, $R_8$, $R_9$, $R_{10}$, and $R_{11}$ and, more particularly, the alkyl portions of said alkoxy, alkoxycarbonyl, alkoxycarbonylamino, hydroxyalkyl, acetoxyalkyl groups and of the alkyl groups associated with a carboxy or sulfo group each preferably contain from 1 to 12, more preferably from 1 to 4 carbon atoms, the total number of carbon atoms included in said groups preferably being no more than 20.

The aryl groups included in said substituents $R_6$, $R_7$, $R_8$ and $R_9$ each preferably contain from 6 to 18, more preferably from 6 to 10 carbon atoms, the total number of carbon atoms included in said groups arriving up to 20 carbon atoms.

The following are specific examples of J-band sensitizing dyes belonging to those represented by the general formula (II) above:

| Col. | $R_{10}$ | $R_6$ | $R_7$ | $R_8$ | $R_9$ | $R_{11}$ | $R_{12}$ | X*** | n |
|---|---|---|---|---|---|---|---|---|---|
| A* | $C_2H_6$ | H | 5-Cl | H | 5'-Cl | $(CH_2)_3SO_3$ | $(CH_2)_3SO_3H$ | – | 1 |
| B** | $C_2H_6$ | H | 5-Cl | H | 5'-$C_6H_5$ | $(CH_2)_3SO_3$ | $CH_3$ $(CH_2)_2CHSO_3H$ | – | 1 |
| C | $CH_3$ | H | 5-$OCH_3$ | H | 5-$OCH_3$ | $C_2H_6$ | $(CH_2)_3SO_3$ | – | 1 |
| D | $C_2H_6$ | 6-$CH_3$ | 5-Cl | H | 5'-Cl | $(CH_2)_3SO_3$ | $(CH_2)_3SO_3H$ | – | 1 |
| E | $C_2H_6$ | H | 5-Cl | H | 5'-Cl | $C_2H_6$ | $C_2H_6$ | 1 | 2 |

*Triethylamine salt
**Sodium salt
***Sign "–" means that anion is absent

In the most preferred form of this invention, the UV-blue sensitive silver halide emulsion comprises silver halide grains which are not optically sensitized but possess the inherent spectral sensitivity of the known types of photosensitive silver halides. The inherent spectral sensitivity of the conventional silver halide emulsions used in photographic films as known ranges in the ultraviolet and blue region of the electromagnetic spectrum.

The silver halide grains in the radiographic emulsion may be regular grain having a regular crystal structure such as cubic, octahedral, and tetradecahedral, or a spherical or irregular crystal structure, or those having crystal defects such as twin planes, or those having a tabular form, or combinations thereof.

The term "cubic grains" according to the present invention is intended to include substantially cubic grains, that is silver halide grains which are regular cubic grains bounded by crystallographic faces (100), or which may have rounded edges and/or vertices or small faces (111), or may even be nearly spherical when prepared in the presence of soluble iodides or strong ripening agents, such as ammonia. The silver halide grains may be of any required composition for forming a negative silver image, such as silver chloride, silver bromide, silver iodide, silver chlorobromide, silver bromoiodide and the like. Particularly good results are obtained with silver bromoiodide grains, preferably silver bromoiodide grains containing about 0.1 to 15% moles of iodide ions, more preferably about 0.5 to 10% moles of iodide ions and still preferably silver bromoiodide grains having average grain sizes in the range from 0.2 to 3 μm, more preferably from 0.4 to 1.5 μm. Preparation of silver halide emulsions comprising cubic silver halide grains is described, for example, in Research Disclosure, Vol. 176, December 1978, Item 17643, Vol. 184, August 1979, Item 18431 and Vol 308, December 1989, Item 308119.

Other silver halide emulsions according to this invention having highly desirable imaging characteristics are those which employ one or more light-sensitive tabular grain emulsions as disclosed in U.S. Pat. Nos. 4,425,425 and 4,425,426. The tabular silver halide grains contained in the silver halide emulsion layers of this invention have an average diameter:thickness ratio (often referred to in the an as aspect ratio) of at least 3:1, preferably 3:1 to 20:1, more preferably 3:1 to 14:1, and most preferably 3:1 to 8:1. Average diameters of the tabular silver halide grains suitable for use in this invention range from about 0.3 μm to about 5 μm, preferably 0.5 μm to 3 μm, more preferably 0.8 μm to 1.5 μm. The tabular silver halide grains suitable for use in this invention have a thickness of less than 0.4 μm, preferably less than 0.3 μm and more preferably less than 0.2 μm.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 3:1. Each of the above proportions, "15%", "25%" and "50%" means the proportion of the total projected area of the tabular grains having a diameter:thickness ratio of at least 3:1 and a thickness lower than 0.4 μm, as compared to the projected area of all of the silver halide grains in the layer.

As described above, commonly employed halogen compositions of the silver halide grains can be used.

Typical silver halides include silver chloride, silver bromide, silver iodide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol % silver iodide, preferably from 0.2 to 5 mol % silver iodide, and more preferably from 0.5 to 1.5 mol % silver iodide. The halogen composition of individual grains may be homogeneous or heterogeneous.

Silver halide emulsions containing tabular silver halide grains can be prepared by various processes known for the preparation of radiographic elements. Silver halide emulsions can be prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No. 2 (1962), pp. 121–125, in Gutoff, "Nucleation and Growth Rates During the Precipitation of Silver Halide Photographic Emulsions", Photographic Science and Engineering, Vol. 14, No. 4 (1970), pp. 248–257, in Berry et al., "Effects of Environment on the Growth of Silver Bromide Microcrystals", Vol. 5, No. 6 (1961), pp. 332–336, in U.S. Pat. Nos. 4,063,951, 4,067,739, 4,184,878, 4,434,226, 4,414,310, 4,386,156, 4,414,306 and in EP Pat. Appln. No. 263,508.

In preparing the silver halide emulsions of the present invention, a wide variety of hydrophilic dispersing agents for the silver halides can be employed. Gelatin is preferred, although other colloidal materials such as gelatin derivatives, colloidal albumin, cellulose derivatives or synthetic hydrophilic polymers can be used as known in the art. Other hydrophilic materials useful known in the art are described, for example, in Research Disclosure, Vol. 308, Item 308119, Section IX. In a preferred aspect of the present invention highly deionized gelatin is used. The highly deionized gelatin is characterized by a higher deionization with respect to the commonly used photographic gelatins. Preferably, the gelatin for use in the present invention is almost completely deionized which is defined as meaning that it presents less than 50 ppm (parts per million) of $Ca^{++}$ ions and is practically free (less than 5 parts per million) of other ions such as chlorides, phosphates, sulfates and nitrates, compared with commonly used photographic gelatins having up to 5,000 ppm of $Ca^{++}$ ions and the significant presence of other ions.

The highly deionized gelatin can be employed not only in the silver halide emulsion layers, but also in other component layers of the radiographic element, such as overcoat layers, interlayers and layers positioned beneath the emulsion layers. In the present invention, preferably at least 50%, more preferably at least 70% of the total hydrophilic colloid of the radiographic element comprises highly deionized gelatin. The amount of gelatin employed in the radiographic element of the present invention is such as to provide a total silver to gelatin ratio higher than 1 (expressed as grams of Ag/grams of gelatin). In particular the silver to gelatin ratio of the silver halide emulsion layers is in the range of from 1 to 1.5.

The radiographic element of the present invention can be forehardened to provide a good resistance in rapid processing conducted in automatic processing machine without the use of hardeners in processing solutions. Examples of gelatin hardeners are aldehyde hardeners, such as formaldehyde, glutaraldehyde and the like, active halogen hardeners, such as 2,4-dichloro-6-hydroxy-1,3,5-triazine, 2-chloro-4,6-hydroxy-1,3,5-triazine and the like, active vinyl hardeners, such as bis-vinylsulfonyl-methane, 1,2-vinylsulfonyl-ethane, bis-vinylsulfonyl-methyl ether, 1,2-bis-vinylsulfonylethyl ether and the like, N-methylol hardeners, such as dimethylolurea, methyloldimethyl hydantoin and the like, and bi-,tri-,or tetravinylsulfonyl substituted organic hydroxy compounds, such as 1,3-bis-vinylsulfonyl-2-propanol and the like. Other useful gelatin hardeners may be found in Research Disclosure, Vol. 308, December 1989, Item 308119, Paragraph X.

The above described gelatin hardeners may be incorporated in the silver halide emulsion layer or in a layer of the silver halide radio-graphic element having a water-permeable relationship with the silver halide emulsion layer. Preferably, the gelatin hardeners are incorporated in the silver halide emulsion layer.

The amount of the above described gelatin hardener that is used in the silver halide emulsion of the radiographic element of this invention can be widely varied. Generally, the gelatin hardener is used in amounts of from 0.5% to 10% by weight of hydrophilic dispersing agent, such as the above described highly deionized gelatin, although a range of from 1% to 5% by weight of hydrophilic dispersing agent is preferred.

The gelatin hardeners can be added to the silver halide emulsion layer or other components layers of the radiographic element utilizing any of the well-known techniques in emulsion making. For example, they can be dissolved in either water or a water-miscible solvent as methanol, ethanol, etc. and added into the coating composition for the above mentioned silver halide emulsion layer or auxiliary layers.

The silver halide emulsions can be chemically and optically sensitized by known methods. The silver halide emulsion layers can contain other constituents generally used in photographic products, such as binders, hardeners, surfactants, speed-increasing agents, stabilizers, plasticizers, optical sensitizers, dyes, ultraviolet absorbers, etc., and reference to such constituents can be found, for example, in Research Disclosure, Vol. 176, December 1978, Item 17643, Vol. 184, August 1979, Item 18431 and Vol 308, December 1989, Item 308119.

The radiographic element of this invention can be prepared by coating the light-sensitive silver halide emulsion layers and other auxiliary layers on a support. Examples of materials suitable for the preparation of the support include glass, paper, polyethylene-coated paper, metals, poly-meric film such as cellulose nitrate, cellulose acetate, polystyrene, polyethylene terephthalate, polyethylene, polypropylene and other well known supports. Preferably, the silver halide emulsion layers are coated on the support at a total silver coverage of at least 1 $g/m^2$, preferably in the range of from 2 to 5 $g/m^2$.

The radiographic element according to the present invention is associated with the intensifying screens so as to be exposed to the radiations emitted by said screens. The pair of screens employed in combination with the radiographic element of the present invention is symmetrical. The screens are made of relatively thick phosphor layers which transform the x-rays into light radiation (e.g., visible light). The screens absorb a portion of x-rays much larger than the radiographic element and are used to reduce the radiation doses necessary to obtain a useful image.

The phosphors used in the intensifying screens applied in the present invention have an emission maximum wavelength in the ultraviolet, blue, green or red region of the electromagnetic spectrum according to the different regions of the electromagnetic spectrum to which said at least two silver halide emulsion layers are sensitized. More preferably, said phosphors emit radiations in the ultraviolet, blue and green regions of the electromagnetic spectrum.

In a most preferred embodiment of the present invention a pair of intensifying screens comprising a mixture of from 0 to 100% of a green emitting phosphor and of from 100 to 0% of a UV-blue emitting phosphor is used in combination with the above described radiographic elements of FIG. 1. This means that the intensifying screen of the present invention can comprise two phosphors, the former emitting a radiation light having an emission maximum in the green region of the electromagnetic spectrum, the latter emitting a radiation light having an emission maximum in the UV-blue region of the electromagnetic spectrum. Alternatively, a single phosphor emitting in both the green and UV-blue region of the electromagnetic spectrum can be used. A screen comprising a phosphor emitting only in the UV-blue or green portion of the spectrum, respectively, can also be used in order to have a radiographic image having the higher or the lower contrast.

In any case, the radiographic element of the present invention is interposed between a couple of screens having the same phosphor or phosphor ratio and the same emission or emission ratio.

More preferably, said green emitting phosphors emit radiation having more than about 80% of its spectral emission above 480 nm and its maximum of emission in the wavelength range of 530–570 nm. Green emitting phosphors which may be used in the intensifying screens of the present invention include rare earth activated rare earth oxysulfide phosphors of at least one rare earth element selected from yttrium, lanthanum, gadolinium and iutetium, rare earth activated rare earth oxyhalide phosphors of the same rare earth elements, a phosphor composed of a borate of the above rare earth elements, a phosphor composed of a phosphate of the above rare earth elements and a phosphor composed of tantalate of the above rare earth elements. These rare earth green emitting phosphors have been extensively described in the patent literature, for example in U.S. Pat. Nos. 4,225,653, 3,418,246, 3,418,247, 3,725,704, 3,617,743, 3,974,389, 3,591,516, 3,607,770, 3,666,676, 3,795,814, 4,405,691, 4,311,487 and 4,387,141. These rare earth phosphors have a high X-ray stopping power and high efficiency of light emission when excited with X radiation and enable radiologists to use substantially lower X radiation dosage levels. Particularly suitable phosphors for use in the intensifying screens of the present invention are terbium or terbium-thulium activated rare earth oxysulfide phosphors represented by the following general formula:

$$(Ln_{1-a-b}, Tb_a, Tm_b)_2O_2S$$

wherein Ln is at least one rare earth element selected from lanthanum, gadolinium and lutetium, and a and b are numbers such as to meet the conditions $0.0005 \leqq a \leqq 0.09$ and $0 \leqq b \leqq 0.01$, respectively, and terbium or terbium-thulium activated rare earth oxysulfide phosphors represented by the following general formula:

$$(Y_{1-c-a-b}, Ln_c, Tb_a, Tm_b)_2O_2S$$

wherein Ln is at least one rare earth element selected from lanthanum, gadolinium and lutetium, and a, b and c are numbers such as to meet the conditions $0.0005 \leqq a \leqq 0.09$, $0 \leqq b \leqq 0.01$ and $0.65 \leqq c \leqq 0.95$, respectively.

Figure 4:
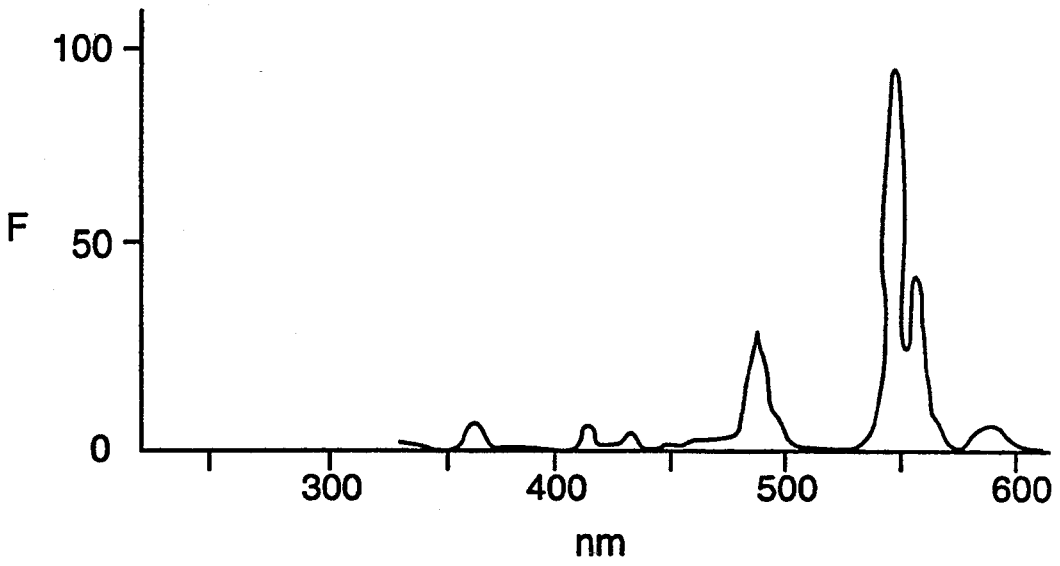
FIGS. 4 and 5 are graphs illustrating the emission spectra of green and UV-blue emitting phosphors useful in the present invention.

FIG. 4 shows an emission spectrum of an intensifying screen comprising a fluorescent layer of (Gd1-0.05, Tb0.05)2O2S phosphor as green emitting phosphor, expressed as fluorescence (F) versus wavelengths (nm).

More preferably, said UV-blue emitting phosphors emit radiation having more than about 80% of their spectral emission below 450 nm and their maximum of emission in the wavelength range of 300–400 nm. UV-blue emitting phosphors which may be used in the intensifying screens of the present invention include UV-blue emitting phosphors known in the art such as lead or lanthanum activated barium sulfate phosphors, barium fluorohalide phosphors, lead activated barium silicate phosphors, gadolinium activated yttrium oxide phosphors, barium fluoride phosphors, alkali metal activated rare earth niobate or tantalate phosphors etc. UV-blue emitting phosphors are described for example in BE 703,998 and 757,815, in EP 202,875 and by Buchanan et al., J. Applied Physics, vol. 9, 4342–4347, 1968, and by Clapp and Ginther, J. of the Optical Soc. of America, vol. 37, 355–362, 1947. Particularly suitable UV-blue emitting phosphors for use in the intensifying screens of the present invention are those represented by the following general formula:

$$(Y_{1-\frac{2}{3}x-\frac{1}{3}y}, Sr_x, Li_y)TaO_4$$

wherein x and y are numbers such as to meet the conditions $10^{-5} \leqq x \leqq 1$ and $10^{-4} \leqq y \leqq 0.1$ as described in EP 202,875.

Figure 5:
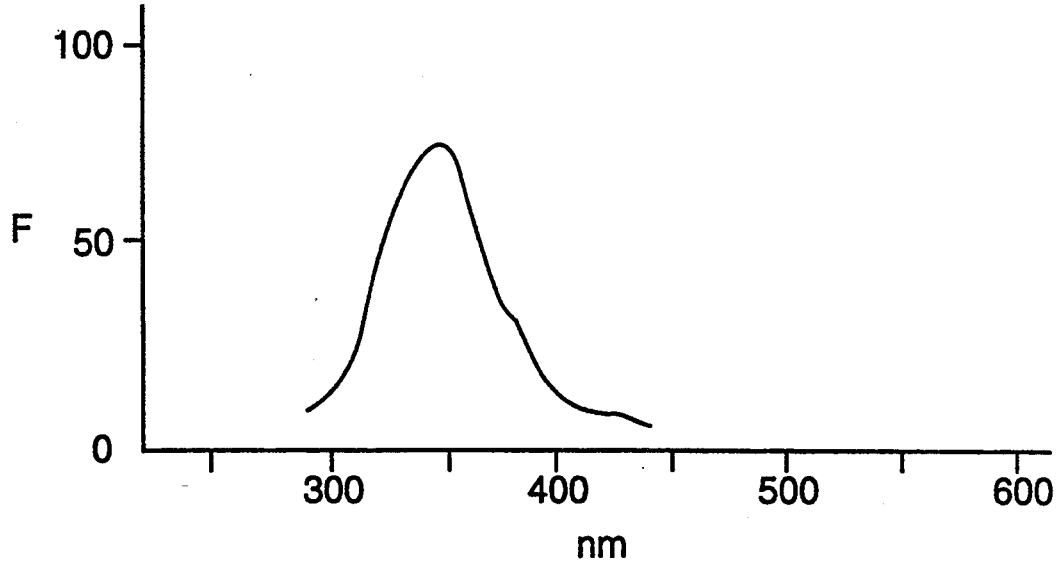

FIG. 5 shows an emission spectrum of an intensifying screen comprising a fluorescent layer of (Y, Sr, Li)-$TaO_4$ phosphor as UV-blue emitting phosphor, expressed as fluorescence (F) versus wavelengths (nm).

References to other well known kind of light emitting phosphors can be found in Research Disclosure, Vol. 184, August 1979, Item 18431, Section IX.

The intensifying screens of this invention have a fluorescent layer comprising a binder and at least one phosphor dispersed therein. The fluorescent layer is formed by dispersing the phosphor(s) in the binder to prepare a coating dispersion having the desired phosphor weight ratio, and then applying the coating dispersion by a conventional coating method to form a uniform layer. Although the fluorescent layer itself can be an intensifying screen when the fluorescent layer is self-supporting, the fluorescent layer is generally provided on a substrate to form an intensifying screen. Further, a protective layer for physically and chemically protecting the fluorescent layer is usually provided on the surface of the fluorescent layer. Furthermore, a primer layer is sometimes provided between the fluorescent layer and the substrate to closely bond the fluorescent layer to the substrate, and a reflective layer is sometimes provided between the substrate (or the primer) and the fluorescent layer.

The binder employed in the fluorescent layer of the intensifying screens of the present invention, can be, for example, one of the binders commonly used in forming layers: gum arabic, protein such as gelatin, polysaccharides such as dextran, organic polymer binders such as polyvinylbutyral, polyvinylacetate, nitrocellulose, ethylcellulose, vinylidene-chloride-vinylchloride copolymer, polymethylmethacrylate, polybutylmethacrylate, vinylchloride-vinylacetate copolymer, polyurethane, cellulose acetate butyrate, polyvinyl alcohol, and the like.

Generally, the binder is used in an amount of 0.01 to 1 part by weight per one part by weight of the phosphor. However, from the viewpoint of the sensitivity and the sharpness of the screen obtained, the amount of the binder should preferably be small. Accordingly, in consideration of both the sensitivity and the sharpness of the screen and the easiness of application of the coating dispersion, the binder is preferably used in an amount of 0.03 to 0.2 parts by weight per one part by weight of the phosphor. The thickness of the fluorescent layer is generally within the range of 10 $\mu$m to 1 mm.

In the intensifying screens of the present invention, the fluorescent layer is generally coated on a substrate. As the substrate, various materials such as polymer material, glass, wool, cotton, paper, metal, or the like can be used. From the viewpoint of handling the screen, the substrate should preferably be processed into a sheet or a roll having flexibility. In this connection, as the substrate is preferably either a plastic film (such as a cellulose triacetate film, polyester film, polyethylene terephthalate film, polyamide film, polycarbonate film, or the like), or ordinary paper or processed paper (such as a photographic paper, baryta paper, resin-coated paper, pigment-containing paper which contains a pigment such as titanium dioxide, or the like). The substrate may have a primer layer on one surface thereof (the surface on which the fluorescent layer is provided) for the purpose of holding the fluorescent layer tightly. As the material of the primer layer, an ordinary adhesive can be used. In providing a fluorescent layer on the substrate (or on the primer layer or on the reflective layer), a coating dispersion comprising the phosphor dispersed in a binder may be directly applied to the substrate (or to the primer layer or to the reflective layer).

Further, in the intensifying screens of the present invention, a protective layer for physically and chemically protecting the fluorescent layer is generally provided on the surface of the fluorescent layer intended for exposure (on the side opposite the substrate). When, as mentioned above, the fluorescent layer is self-supporting, the protective layer may be provided on both surfaces of the fluorescent layer. The protective layer may be provided on the fluorescent layer by directly applying thereto a coating dispersion to form the protective layer thereon, or may be provided thereon by bonding thereto the protective layer formed beforehand. As the material of the protective layer, a conventional material for a protective layer such a nitrocellulose, ethylcellulose, cellulose acetate, polyester, polyethyleneterephthalate, and the like can be used.

The intensifying screens of the present invention may be colored with a colorant. Further, the fluorescent layer may contain a white powder dispersed therein. By using a colorant or a white powder, an intensifying screen which provides an image of high sharpness can be obtained.

As previously disclosed the radiographic element of the present invention, such as, for example, the radiographic elements of FIG. 1*a* and b, after exposure and development shows an average contrast measured between 0.25 above Dmin and 2.00 above Dmin propodionally variable with the emission ratio of said light emitting phosphors.

It is worth noticing that the construction of the radiographic assembly of the present invention is symmetrical, that is, the pair of screens and the two side of the double coated radiographic element are identical and specular. The variation of the sensitometric results, specifically of the average contrast, is due to the specific contruction of the radiographic element of the present invention, in combination with the emission of the intensifying screens. In particular, the higher the proportion of phosphors emitting light in the portion of the spectrum to which is sensitized the higher average contrast emulsion, the higher will be the average contrast of the radiographic element, and vice versa. In case of a single phosphor, the higher is tile emission in the portion of the spectrum to which is sensitized the higher average contrast emulsion, the higher will be the average contrast of the radiographic element, and vice versa. On the other hand, the reduction of the average contrast corresponds to a softer sensitometric curve with an increase of the toe contrast, so obtaining the sensitometric characteristics useful to better detect, on a single radiographic element, parts of the human body having different X-ray absorption. FIG. 2 clearly shows the reduction of the slope of the sensitometric curve by increasing the percentage of green emitting phosphor in the intensifying screens (the radiographic element having the structure of FIG. 1*a*, wherein the green sensitive emulsion layer has the lower contrast). FIG. 3 shows a similar result with the radiographic element of FIG. 1*b*.

By using the specific construction of the present invention, which is not intended to be limited to two silver halide emulsion layers and to green and UV-blue light emitting phosphors, it is then possible to change the contrast of the radiographic element simply by changing the phosphor mixture ratio and/or the emission ratio of the intensifying screens. Whatever the phosphor mixture ratio and/or the emission ratio could be, these will be identical for each pair of the intensifying screens.

In addition to the features specifically described above, the radiographic elements of this invention, in the silver halide emulsion layers or in other layers, can include additional addenda of conventional nature, such as stabilizers, antifoggants, brighteners, absorbing materials, hardeners, coating aids, plasticizers, lubricants, matting agents, antikinking agents, antistatic agents, and the like, as described in Research Disclosure, Vol. 176, December 1978, Item 17643, in Research Disclosure, Vol. 184, August 1979 Item 18431, and in Research Disclosure, Vol. 308, December 1989, Item 308119.

As regards the processes for the silver halide emulsion preparation and the use of particular ingredients in the emulsion and in the light-sensitive element, reference is made to Research Disclosure 184, Item 18431, August 1979, wherein the following chapters are dealt with in deeper details:

IA. Preparation, purification and concentration methods for silver halide emulsions.
IB. Emulsion types.
IC. Crystal chemical sensitization and doping.
II. Stabilizers, antifogging and antifolding agents.
IIA. Stabilizers and/or antifoggants.
IIB. Stabilization of emulsions chemically sensitized with gold compounds.
IIC. Stabilization of emulsions containing polyalkylene oxides or plasticizers.
IID. Fog caused by metal contaminants.
IIE. Stabilization of materials comprising agents to increase the covering power.
IIF. Antifoggants for dichroic fog.
IIG. Antifoggants for hardeners and developers comprising hardeners.
IIH. Additions to minimize desensitization due to folding.
III. Antifoggants for emulsions coated on polyester bases.
IIJ. Methods to stabilize emulsions at safety lights.
IIK. Methods to stabilize x-ray materials used for high temperature. Rapid Access, roller processor transport processing.
IIL. Compounds and antistatic layers.
IV. Protective layers.
V. Direct positive materials.
VI. Materials for processing at room light.
VII. X-ray color materials.
VIII. Phosphors and intensifying screens.
IX. Spectral sensitization.
X. UV-sensitive materials
XII. Bases

EXAMPLES

SCREENS

A set of radiographic screens were prepared by coating a homogeneous mixture of a UV-blue emitting (Y, Sr, Li)$TaO_4$ phosphor manufactured by Nichia Kagaku Kogyo K.K. under the trade name of NP-3040-03M-03 with average particle grain size of 5.4 μm and of a green emitting $Gd_2O_2S$:Tb phosphor manufactured by Nichia Kagaku Kogyo K.K. under the trade name NP-3010-32M-01 with average particle grain size of 5.4 μm in a hydrophobic polymer binder at a phosphor coverage of 450 g/m$^2$ and a thickness of 110 μm on a polyester support according to the following scheme. Between the phosphor layer and the support a reflective layer of $TiO_2$ particles in a polyurethane binder was coated. The screen was overcoated with a cellulose triacetate protective layer of 5 μm.

| Phosphor Screen | UV-Blue % | Green % |
|---|---|---|
| G0 | 100 | 0 |
| G25 | 75 | 25 |
| G50 | 50 | 50 |
| G75 | 25 | 75 |
| G100 | 0 | 100 |

SCREEN C1

This screen has a composition and structure corresponding to that of the commercial Trimax TM T6 screen, a medium resolution screen manufactured by 3M Company. It consists of a terbium activated gadolinium oxysulfide phosphor having an average particle size of 5.1 μm coated in a hydrophobic polymer binder at a phosphor coverage of 510 g/m$^2$ and a thickness of 139 μm on a polyester support. Between the phosphor layer and the support a reflective layer of $TiO_2$ particles in a polyurethane binder was coated. The screen was overcoated with a cellulose triacetate layer. Screen C1 emits only green light.

SCREEN C2

This screen has a composition and structure corresponding to that of the commercial Trimax TM T8 screen, a medium resolution screen manufactured by 3M Company. It consists of a green emitting terbium activated gadolinium oxysulfide phosphor having an average particle size of 8.2 μm coated in a hydrophobic polymer binder at a phosphor coverage of 420 g/m$^2$ and a thickness of 105 μm on a polyester support. Between the phosphor layer and the support a reflective layer of $TiO_2$ particles in a polyurethane binder was coated. The screen was overcoated with a cellulose triacetate layer. Screen C2 emits almost entirely green light.

SCREEN C3

This screen has a composition and structure corresponding to that of the commercial Trimax TM T16 screen, a high speed screen manufactured by 3M Company. It consists of a terbium activated gadolinium oxysulfide phosphor having an average particle size of 8.5 μm coated in a hydrophobic polymer binder on a polyester support. The front screen has a phosphor coverage of 480 g/m$^2$ and a thickness of 120 μm, the back screen has a phosphor coverage of 1015 g/m$^2$ and a thickness of 250 μm. Between the phosphor layer and the support a reflective layer of $TiO_2$ particles in a polyurethane binder was coated. The screen was overcoated with a cellulose triacetate layer. Screen C3 emits a significant amount of UV-blue light in addition to the green light.

SILVER HALIDE EMULSIONS

The following silver halide emulsions were prepared:

GREEN SENSITIVE EMULSION (GS)

A silver halide emulsion was prepared by mixing 450 grams of a cubic silver bromoiodide emulsion having 2 mole percent iodide and an average grain size of 1.35 μm, 270 grams of a cubic silver bromoiodide emulsion having 2 mole percent iodide and an average grain size of 0.8 μm, 180 grams of an octahedral silver chlorobromoiodide emulsion having 1.2 mole percent iodide and 84 mole percent bromide and an average grain size of 0.7 μm, and 100 grams of an octahedral silver bromoiodide emulsion having 1.5 mole percent iodide and an average grain size of 0.4 μm. The emulsion was sulfur and gold chemically sensitized, spectrally sensitized with 500 mg/mole Ag of the green sensitizing Dye A, anhydro-5,5'-dichloro-9-ethyl-3,3'-bis(3-sulfopropyl)-oxacarbocyanine hydroxide triethyl-amine salt, and added with resorcylaldehyde and dimethylol urea hardeners.

BLUE SENSITIVE EMULSION (BS)

A silver halide emulsion containing cubic silver bromoiodide grains having 2 mole percent iodide and an average grain size of 0.8 μm was prepared. The emulsion was sulfur and gold chemically sensitized, and added with resorcylaldehyde and dimethylol urea hardeners.

EMULSION SENSITOMETRY

The above described GS emulsion was coated as single side at a silver coverage of 2.5 g/m$^2$ and exposed by a green emitting phosphor screen consisting of a $Gd_2O_2S$:Tb phosphor with average particle grain size of 8.5 μm coated in a hydrophobic polymer binder at a phosphor coverage of 1050 g/m$^2$ and a thickness of 270 μm on a polyester support.

The above described BS emulsion was coated as single side at a silver coverage of 2.5 g/m$^2$ and exposed by an UV-blue emitting phosphor screen consisting of the type NP-3040 (Y, Sr, Li)$TaO_4$ phosphor of Nichia Kagaku Kogyo K.K. with average particle grain size of 5.4 μm coated in a hydrophobic polymer binder at a phosphor coverage of 300 g/m$^2$ and a thickness of 75 μm on a polyester support.

The GS emulsion exhibited a speed of 0.90 logE (where E represents exposure in meter-candle-seconds) higher than that of the BS emulsion. The above speed is referred to a density of 0.50 above Dmin. If the speed is measured at a density of 1.0 above Dmin the speed difference is 0.20 logE.

The GS emulsion exhibited an average contrast of 0.6. The BS emulsion exhibited an average contrast of 2.0. All average contrasts in the examples are based on density measurements at 0.25 and 1.00 above Dmin.

RADIOGRAPHIC FILMS

A light-sensitive film was prepared in the following manner (FILM 1). On both sides of a 7 mil polyester support was coated the above described GS emulsion at 1.2 g/m$^2$ Ag and 0.9 g/m$^2$ gelatin. On this first layer was simultaneously coated the above described BS emulsion at 1.2 g/m$^2$ Ag and 0.9 g/m$^2$ gelatin. A protective overcoat containing 1.2 g/m$^2$ gelatin was applied on both side of the resulting film.

A light-sensitive film was prepared in the following manner (FILM 2). On both sides of a 7 mil polyester support was coated the above described BS emulsion at 1.2 g/m$^2$ Ag and 0.9 g/m$^2$ gelatin. On this first layer was simultaneously coated the above described GS emulsion at 1.2 g/m$^2$ Ag and 0.9 g/m$^2$ gelatin. A protective overcoat containing 1.2 g/m$^2$ gelatin was applied on both side of the resulting film.

A light-sensitive film (FILM 3) corresponding to the commercial XLA+ extended latitude radiographic film sold by 3M Company was used as comparison. Film 3 is obtained by coating a tabular silver bromide grain emulsion having an average thickness lower than 0.4 μm and an aspect ratio lower than 8:1 on both side of a blue tinted polyester film support at a silver coverage of 2.1 g/m$^2$ per side and a gelatin coverage of 2.85 g/m$^2$. The emulsion was previously chemically sensitized with sodium p-toluenethiosulfonate, sodium p-toluenesulfinate and benzothiazoleiodoethylate and spectrally sensitized to the green light with the above described dye A.

RADIOGRAPHIC ASSEMBLIES

A set of radiographic assemblies was prepared by interposing the above described radiographic elements between a pair of the above described screens according the following Table 1. All the radiographic assemblies are symmetrical, that is the radiographic element is interposed between an equal pair of screens.

TABLE I

| Assembly | Screen | Film |
|---|---|---|
| 1 | G0 | 1 |
| 2 | G25 | 1 |
| 3 | G50 | 1 |
| 4 | G75 | 1 |
| 5 | G100 | 1 |
| 6 | G0 | 2 |
| 7 | G25 | 2 |
| 8 | G50 | 2 |
| 9 | G75 | 2 |
| 10 | G100 | 2 |
| 11 | C1 | 3 |
| 12 | C2 | 1 |
| 13 | C3 | 1 |
| 14 | C2 | 2 |
| 15 | C3 | 2 |

The above described radiographic assemblies were exposed to X-rays from a tungsten target tube operated at 80 kVp and 25 mA from a distance of 120 cm. The X-rays passed through an aluminum step wedge before reaching the radiographic assembly. Following exposure the films were processed in a 3M Trimatic TM XP515 processor at a total processing time of 90 seconds using the developer and fixer having the following composition:

| DEVELOPER | | |
|---|---|---|
| KOH (sol. 35% by weight) | g | 105 |
| Acetic acid | 9 | 7.6 |
| Glutaraidehyde (sol. 50% by weight) | g | 7.2 |
| Sodium methabisulfite | 9 | 45.0 |
| Ethylene glycol | g | 10.0 |
| Diethyene glycol | g | 4.9 |
| Morpholinometanedifosfonic acid (sol. 40% by wight) | g | 7.5 |
| 5-Methylbenzothazole | mg | 80.0 |
| 5-Nitroindazole | mg | 107.0 |
| 1-Phenyl-1-H-tetrazole-5-thiole | mg | 7.0 |
| Boric acid | g | 1.7 |
| Potassium carbonate | g | 13.25 |
| Ethylenediaminotetraacetic acid. 4Na.2$H_2O$ | g | 1.5 |
| 1-Phenyl-3-pyrazolidone | g | 1.45 |
| Hydroquinone | g | 20.0 |
| NaBr | g | 5.0 |
| Water to make | l | 1 |
| pH | | 10.35 |

| FIXER | | |
|---|---|---|
| Ammonium thiosulfate | g | 145.2 |
| Sodium sulfite | g | 8.12 |
| Boric acid | g | 7.0 |
| Acetic acid | g | 7.52 |
| Ammonium acetate | g | 19.24 |
| Aluminum sulfate | g | 7.74 |
| Sulfuric acid | g | 3.58 |
| 2-Phenoxyethanol | g | 0.12 |
| Water to make | l | 1 |
| pH | | 14.30 |

Figure 6:
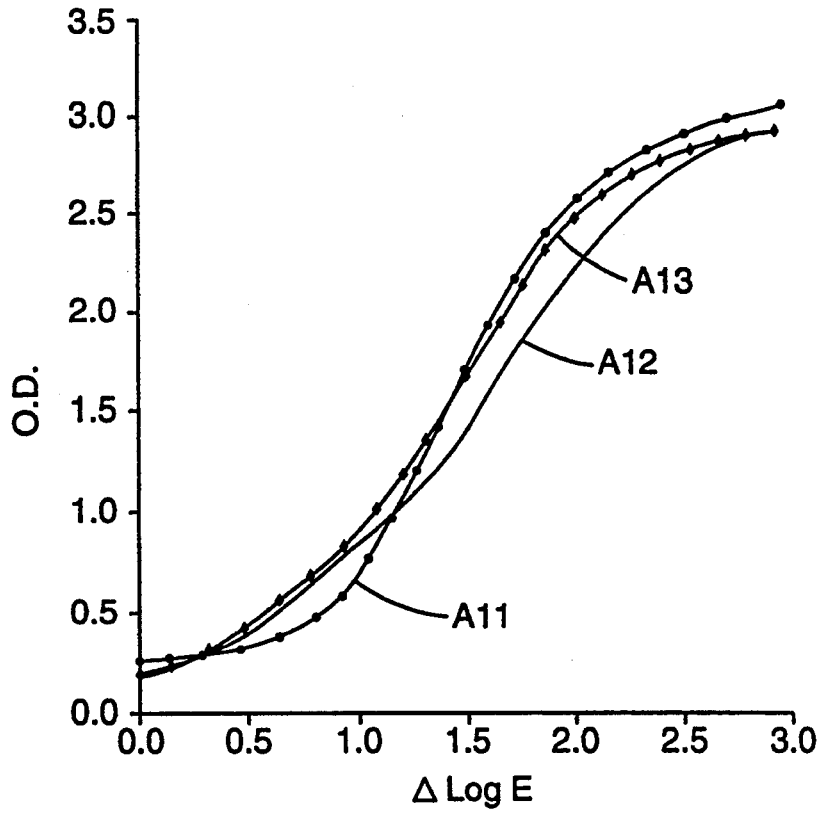
FIGS. 6 and 7 are graphs illustrating the sensitometric curves of the radiographic assemblies of the present invention in comparison with a reference.
Figure 7:
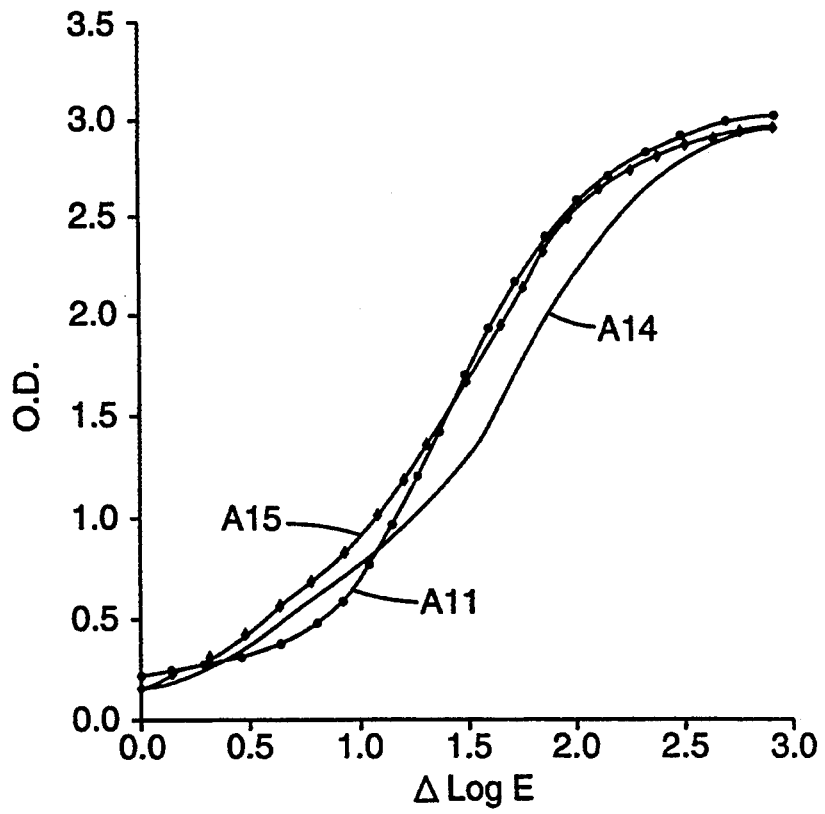

The sensitometric results are summarized in the following table 2. The sensitometric curves of the radiographic assemblies 1 to 5 are showed in FIG. 2 and the sensitometric curves of radiographic assemblies 6 to 10 are showed in FIGS. 3. FIG. 6 and 7 show the sensitometric curves of radiographic assemblies 12 and 13 and of radiographic assemblies 14 and 15, respectively, in comparison with the radiographic assembly 11.

TABLE 2

| Assembly | Average Contrast | Shoulder Contrast | Toe Contrast |
|---|---|---|---|
| 1 | 1.94 | 1.40 | 0.46 |
| 2 | 1.74 | 1.65 | 0.54 |
| 3 | 1.42 | 1.67 | 0.67 |
| 4 | 1.14 | 1.65 | 0.84 |
| 5 | 0.89 | 1.51 | 0.94 |
| 6 | 1.95 | 1.92 | 0.48 |
| 7 | 1.57 | 1.80 | 0.63 |
| 8 | 1.32 | 1.90 | 0.78 |
| 9 | 1.11 | 1.84 | 0.94 |
| 10 | 0.90 | 1.67 | 1.11 |
| 11 | 1.80 | 1.34 | 0.46 |
| 12 | 1.23 | 1.30 | 0.75 |
| 13 | 1.38 | 1.21 | 0.67 |
| 14 | 1.22 | 1.54 | 0.84 |
| 15 | 1.35 | 1.45 | 0.73 |

The data of table 2 show the improvement of the present invention. The films 1 and 2 of the present invention show a contrast proportionally variable with the relative proportion of green and UV-blue emitting light phosphors in the intensifying screen. By varying the composition of the intensifying screens it is then possible to obtain a different sensitometric result with a single radiographic film. Radiographic assemblies 12 to 15 show a similar result due to the different light emission of the phosphor employed in the screens. The C2 screens (corresponding to the commercial TRIMAX TM T8 screens) emit almost entirely green light while C3 screens (corresponding to the commercial TRIMAX TM T16 screens) emit a significant amount of UV-blue light in addition to green light.

We claim:

1. A symmetrical radiographic assembly comprising:

a double side radiographic element which comprises a support and hydrophilic colloid layers coated on each side of said support, and an intensifying screen adjacent to each side of said radiographic element, wherein on each side of said support are coated at least two silver halide emulsion layers, each of said at least two emulsion layers on each side of said support having a speed difference of at least 0.5, said at least two silver halide emulsion layers on each side of said support being each sensitized to a different region of the electromagnetic spectrum, wherein said intensifying screen comprises one or more different light emitting phosphors selected in order to have a radiation light emission having an emission maximum wavelength corresponding to at least one of said different regions of the electromagnetic spectrum to which said at least two silver halide emulsion layers on one side of said support are sensitized, and wherein said radiographic element shows an average contrast proportionally variable with the emission ratio of said light emitting phosphor(s).

2. The radiographic assembly according to claim 1, wherein said intensifying screen comprises two different light emitting phosphors, each of said phosphors being present in a weight percentage A relative to the total weight of the said phosphors, wherein A is a number satisfying the condition $O<A<100$, said phosphors being selected in order to have a radiation light emission having an emission maximum wavelength corresponding to both said different regions of the electromagnetic spectrum to which said at least two silver halide emulsion layers are sensitized.

3. The radiographic assembly according to claim 1 wherein said silver halide emulsion layers are sensitized to radiations having a wavelength selected in the range of from 300 to 1200 nm.

4. The radiographic assembly according to claim 1 wherein said silver halide emulsion layers are sensitized to radiations having a wavelength difference of at least 50 nm.

5. The radiographic assembly according to claim 1 wherein said silver halide emulsion layers have a speed difference of from 0.5 to 2.0 logE and an average contrast difference of from 0.5 to 2.0.

6. The radiographic assembly according to claim 1 wherein the lower average contrast silver halide emulsion layer has a speed from 0.5 to 2.0 higher than the speed of the higher average contrast silver halide emulsion layer.

7. The radiographic assembly according to claim 1 wherein said radiographic element comprises two silver halide emulsion layers coated on each side of said support, one of said silver halide emulsion layers being sensitized to radiation of wavelength longer than 500 nm, and having an average contrast lower than 1.0, the other silver halide emulsion layer being sensitized to radiation of wavelength shorter than 500 nm, and having an average contrast higher than 1.0, said low contrast silver halide emulsion layer having a speed of from 0.5 to 2.0 logE higher than the speed of said high contrast silver halide emulsion layer.

8. The radiographic assembly according to claim 1 wherein said radiographic element comprises two silver halide emulsion layers coated on each side of said support, one of said silver halide emulsion layers being sensitized to radiation of wavelength longer than 500 nm, and having an average contrast higher than 1.0, the other silver halide emulsion layer being sensitized to radiation of wavelength shorter than 500 nm, and having an average contrast lower than 1.0, said low contrast silver halide emulsion layer having a speed of from 0.5 to 2.0 logE higher than the speed of said high contrast silver halide emulsion layer.

9. The radiographic assembly according to claim 1 wherein said intensifying screen comprises at least one phosphor emitting a radiation having a wavelength of from 300 to 1200 nm.

10. The radiographic assembly according to claim 1 wherein said intensifying screen comprises an amount of from 0 to 100% by weight of a green emitting phosphor having its maximum of emission in the range of from 530 to 570 nm and an amount of from 0 to 100% by weight of a UV-blue emitting phosphor having its maximum of emission in the range of from 300 to 400 nm.

11. The radiographic assembly according to claim 10 wherein said green emitting phosphor is represented by the following formula:

$(Ln_{1-a-b}, Tb_a, Tm_b)_2O_2S$ wherein Ln is at least one rare earth element selected from lanthanum, gadolinium and lutetium, and a and b are numbers such as to meet the conditions $0.0005 \leqq a \leqq 0.09$ and $0 \leqq b \leqq 0.01$, respectively.

12. The radiographic assembly according to claim 10 wherein said green emitting phosphor is represented by the following formula:

$(Y_{1-c-a-b}, Ln_c, Tb_a, Tm_b)_2O_2S$ wherein Ln is at least one rare earth element selected from lanthanum, gadolinium and lutetium, and a, b and c are numbers such as to meet the conditions $0.0005 \leqq a \leqq 0.09$, $0 \leqq b \leqq 0.01$ and $0.65 \leqq c \leqq 0.95$, respectively.

13. The radiographic assembly according to claim 10 wherein said UV-blue emitting phosphor is represented by the following formula:

$(Y_{1-\frac{2}{3}x-\frac{1}{3}y}, Sr_x, Li_y)TaO_4$ wherein x and y are numbers such as to meet the conditions $10^{-5} \leqq x \leqq 1$ and $10^{-4} \leqq y \leqq 0.1$.

14. A symmetrical double side radiographic element which comprises a support and hydrophilic colloid layers coated on each side of said support, wherein on each side of said support are coated at least two silver halide emulsion layers having a speed difference of at least 0.5 logE and an average contrast difference of at least 0.5, said at least two silver halide emulsion layers on each side of said support being each sensitized to a different region of the electromagnetic spectrum.

15. The double side radiographic element according to claim 14 wherein said silver halide emulsion layers are sensitized to radiations having a wavelength selected in the range of from 300 to 1200 nm.

16. The double side radiographic element according to claim 14 wherein said silver halide emulsion layers are sensitized to radiations having a wavelength difference of at least 50 nm.

17. The double side radiographic element according to claim 14 wherein said silver halide emulsion layers have a speed difference of from 0.5 to 2.0 logE and an average contrast difference of from 0.5 to 2.0.

18. The double side radiographic element according to claim 14 wherein the lower average contrast silver halide emulsion layer has a speed from 0.5 to 2.0 higher than the speed of the higher average contrast silver halide emulsion layer.

19. The double side radiographic element according to claim 14 wherein said radiographic element comprises two silver halide emulsion layers coated on each side of said support, one of said silver halide emulsion layers being sensitized to radiation of wavelength longer than 500 nm, and having an average contrast lower than 1.0, the other silver halide emulsion layer being sensitized to radiation of wavelength shorter than 500 nm, and having an average contrast higher than 1.0, said low contrast silver halide emulsion layer having a speed of from 0.5 to 2.0 logE higher than the speed of said high contrast silver halide emulsion layer.

20. The double side radiographic element according to claim 14 wherein said radiographic element comprises two silver halide emulsion layers coated on each side of said support, one of said silver halide emulsion layers being a high contrast emulsion layer sensitized to radiation of wavelength longer than 500 nm, and having an average contrast higher than 1.0, the other silver halide emulsion layer being a low contrast emulsion layer sensitized to radiation of wavelength shorter than 500 nm, and having an average contrast lower than 1.0, said low contrast silver halide emulsion layer having a speed of from 0.5 to 2.0 logE higher than the speed of said high contrast silver halide emulsion layer.

21. A process for obtaining a radiographic image comprising the step of:

(a) image-wise exposing an assembly to X-ray radiation after passing said X-ray radiation through an object, said assembly comprising a symmetrical radiographic assembly comprising a double side radiographic element which comprises a support and hydrophilic colloid layers coated on each side of said support, and an intensifying screen adjacent to each side of said radiographic element, wherein on each side of said support are coated at least two silver halide emulsion layers said at least two silver halide emulsion layers on each side of said support having a speed difference of at least 0.5 logE and an average contrast difference of at least 0.5, said at least two silver halide emulsion layers on each side of said support being sensitized to a different region of the electromagnetic spectrum, wherein said intensifying screen comprises one or more different light emitting phosphors selected in order to have a radiation light emission having an emission maximum wavelength corresponding to at least one of said different regions of the electromagnetic spectrum to which said at least two silver halide emulsion layers are sensitized, and (b) developing said exposed radiographic element.

* * * * *

UNITED STATES PATENT AND TRADEMARK OFFICE

CERTIFICATE OF CORRECTION

PATENT NO. : 5,380,636

DATED : January 10, 1995

INVENTOR(S) : Malfatto et al.

It is certified that error appears in the above-indentified patent and that said Letters Patent is hereby corrected as shown below:

Column 1, line 26, delete "pads" and insert --parts--.

Column 10, line 15, delete "in the an" and insert --in the art--.

Column 13, line 53, delete "iutetium," and insert --lutetium,--.

Column 16, line 31, delete "tile" and insert --the--.

Column 20, line 65, delete "pH 14.30" and insert --pH 4.30--.

Column 17, line 31, delete "IIL." and insert --III.--.

Signed and Sealed this

Fourth Day of July, 1995

Bruce Lehman

*Attest:*

BRUCE LEHMAN

*Attesting Officer*

*Commissioner of Patents and Trademarks*